US005523727A

United States Patent [19]

Shingyoji

[11] Patent Number: 5,523,727

[45] Date of Patent: Jun. 4, 1996

[54] DIELECTRIC WAVEGUIDE INCLUDING A TAPERED WAVE ABSORBER

[75] Inventor: Masahito Shingyoji, Saitama, Japan

[73] Assignee: Honda Giken Kogyo Kabushiki Kaisha, Tokyo, Japan

[21] Appl. No.: 343,833

[22] Filed: Nov. 22, 1994

Related U.S. Application Data

[63] Continuation of Ser. No. 96,682, Jul. 23, 1993, abandoned.

[30] Foreign Application Priority Data

Jul. 24, 1992 [JP] Japan ..... 4-239930

[51] Int. Cl.[6] ..... H01P 1/26; H01P 1/22; H01P 3/16

[52] U.S. Cl. ..... 333/22 R; 333/81 B; 333/239; 333/248

[58] Field of Search ..... 333/239, 248, 333/22 R, 81 B

[56] References Cited

U.S. PATENT DOCUMENTS

| | | | |
|---|---|---|---|
| 2,595,078 | 4/1952 | Iams | 333/239 |
| 4,028,643 | 6/1977 | Itoh | 333/239 X |
| 4,463,330 | 7/1984 | Yoneyama | 333/239 |
| 4,511,865 | 4/1985 | Dixon, Jr. | 333/17.2 |
| 4,689,584 | 8/1987 | Sequeira | 333/239 X |

FOREIGN PATENT DOCUMENTS

| | | | |
|---|---|---|---|
| 493179 | 7/1992 | European Pat. Off. | 333/22 F |
| 3-270401 | 12/1991 | Japan | 333/239 |
| 1631632 | 2/1991 | U.S.S.R. | 333/81 B |

OTHER PUBLICATIONS

Millimeter Wave Integrated Circuits Using Nonradiative Dielectric Waveguide, Journal of Institute of Elec. & Comm. Eng. of Japan, C–1, vol. J73–C–1, No. 3, pp. 87–94 (Mar. 1990).

*Primary Examiner*—Benny T. Lee
*Attorney, Agent, or Firm*—Lyon & Lyon

[57] ABSTRACT

A dielectric waveguide has a pair of parallel flat metallic plates spaced from each other, a dielectric strip sandwiched between the parallel flat metallic plates, and a wave absorber sandwiched between the parallel flat metallic plates and extending parallel to the dielectric strip. The wave absorber has a tapered portion which is progressively closer to the dielectric strip in a direction away from an inlet end of the wave absorber. The wave absorber has a side surface which may be held in contact with a side surface of the dielectric strip to provide a termination for eliminating reflections of input electromagnetic waves applied to the nonradiative dielectric waveguide, or may be spaced from a side surface of the dielectric strip to provide an attenuator for attenuating the power of input electromagnetic waves applied to the nonradiative dielectric waveguide.

8 Claims, 2 Drawing Sheets

DIELECTRIC WAVEGUIDE INCLUDING A TAPERED WAVE ABSORBER

This is a continuation of application Ser. No. 08/096,682, filed on Jul. 23, 1993, now abandoned, and which designated the U.S.

BACKGROUND OF THE INVENTION

1. Field of the Invention

The present invention relates to a dielectric waveguide having a dielectric strip interposed between a pair of parallel flat electrically conductive plates, for propagating millimetric waves therethrough.

2. Description of the Prior Art

Electromagnetic waves which are polarized parallel to the wall surfaces of parallel metallic plates are blocked and cannot propagate along the parallel metallic plates if the distance between the parallel metallic plates is half the wavelength of the electromagnetic waves or less. When a dielectric strip is inserted between the parallel metallic plates, however, electromagnetic waves can propagate along the parallel metallic plates, but radiative waves are completely suppressed by the cut-off effect of the parallel metallic plates. Based on such principles, there has been proposed, as shown in FIGS. 1 and 2 of the accompanying drawings, a nonradiative dielectric waveguide (NRD) having a dielectric strip 3 sandwiched between parallel metallic plates 1, 2 (see Journal of Electronic Information Communications Society, C-1, Vol. J73-C-1, No. 3, pages 87–94, published March 1990).

Other conventional nonradiative dielectric waveguides have a termination as shown in FIGS. 3 and 4 of the accompanying drawings.

The nonradiative dielectric waveguide shown in FIG. 3 comprises a pair of parallel flat plates 1, 2 and a dielectric strip 3 sandwiched between the parallel flat plates 1, 2. Resistive films 4 of NiCr with tapered ends 41 for attenuating the reflection of input electromagnetic waves are applied to respective opposite sides of the dielectric strip 3. The tapered ends 41 serve as a termination for eliminating reflections. However, since attenuation factor of electromagnetic waves per unit length along the dielectric strip 3 is relatively small, the termination is relatively long.

The nonradiative dielectric waveguide shown in FIG. 4 also comprises a pair of parallel flat plates 1, 2 and a dielectric strip 3 sandwiched between the parallel flat plates 1, 2. The dielectric strip 3 is divided into two layers parallel to the parallel flat plates 1, 2, and a resistive film 5 with a tapered end 51 being inserted between the layers of the dielectric strip 3. The tapered end 51 serves as a termination for eliminating reflections. The attenuation factor of electromagnetic waves per unit length along the dielectric strip 3 is greater than, and hence the termination is shorter than the case with the nonradiative dielectric waveguide shown in FIG. 3. However, the nonradiative dielectric waveguide shown in FIG. 4 fails to have uniform characteristics because of a complex process required to manufacture the nonradiative dielectric waveguide, i.e., separating the dielectric strip 3 into two layers, placing the resistive film 5 between the layers, and bonding them together.

Generally, nonradiative dielectric waveguides have such an electromagnetic field intensity distribution that the electromagnetic field is greatest in the dielectric strip and becomes smaller in a direction away from the dielectric strip depending exponentially on the distance from the dielectric strip. Since the nonradiative dielectric waveguides shown in FIGS. 3 and 4 have the respective resistive films 4, 5 directly combined with the dielectric strips 3 where the electromagnetic field intensity is high, the resistive films 4, 5 are highly exposed to electromagnetic waves, and electromagnetic wave reflections tend to vary greatly with small changes in the shape of the resistive films 4, 5. Accordingly, it has been difficult to obtain desired attenuation and reflection characteristics for the nonradiative dielectric waveguides shown in FIGS. 3 and 4, particularly uniform attenuation and reflection characteristics when the nonradiative dielectric waveguides shown in FIGS. 3 and 4 are mass-produced.

SUMMARY OF THE INVENTION

It is therefore an object of the present invention to provide a dielectric waveguide which is relatively simple in structure.

Another object of the present invention is to provide a dielectric waveguide having desired attenuation and reflection characteristics, particularly uniform attenuation and reflection characteristics when the dielectric waveguide is mass-produced.

According to the present invention, there is provided a dielectric waveguide comprising an electrically conductive plate, a dielectric strip mounted on the electrically conductive plate, and a wave absorber disposed on the electrically conductive plate parallel to the dielectric strip, the wave absorber having a tapered portion which is progressively closer to the dielectric strip in a direction away from an inlet end of the wave absorber.

According to the present invention, there is also provided a dielectric waveguide comprising a pair of parallel flat metallic plates spaced from each other, a dielectric strip sandwiched between the parallel flat metallic plates, and a wave absorber sandwiched between the parallel flat metallic plates and extending parallel to the dielectric strip, the wave absorber having a tapered portion which is progressively closer to the dielectric strip in a direction away from an inlet end of the wave absorber.

The wave absorber has a side surface which may be held in contact with a side surface of the dielectric strip to provide a termination for eliminating reflections of input electromagnetic waves applied to the dielectric waveguide, or may be spaced from a side surface of the dielectric strip to provide an attenuator for attenuating the power of input electromagnetic waves applied to the dielectric waveguide.

The above and further objects, details and advantages of the present invention will become apparent from the following detailed description of preferred embodiments thereof, when read in conjunction with the accompanying drawings.

DETAILED DESCRIPTION OF THE PREFERRED EMBODIMENTS

Figure 1:
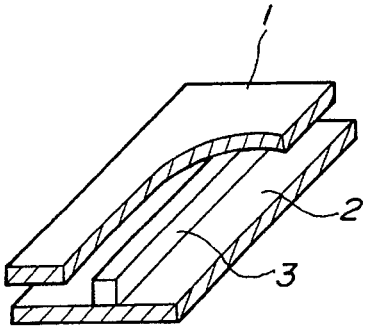
FIG. 1 PRIOR ART
FIG. 1 is a fragmentary perspective view of a prior art nonradiative dielectric waveguide.
Figure 2:
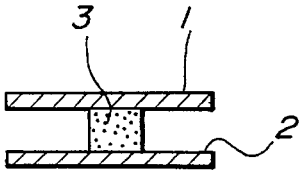
FIG. 2 PRIOR ART
FIG. 2 is a transverse cross-sectional view of the nonradiative dielectric waveguide shown in FIG. 1.
Figure 3:
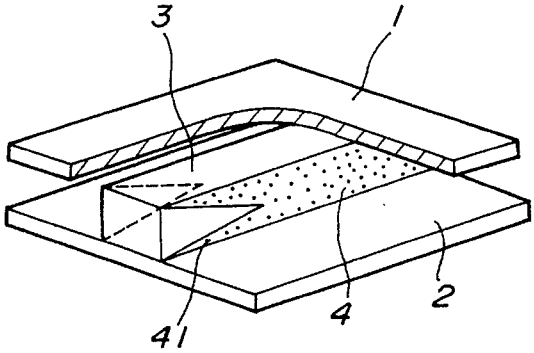
FIG. 3 PRIOR ART
FIG. 3 is a fragmentary perspective view of a prior art nonradiative dielectric waveguide with a termination.
Figure 4:
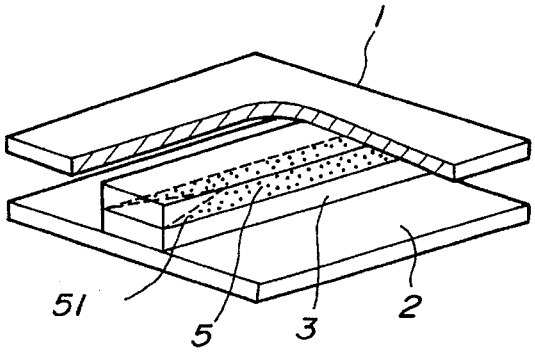
FIG. 4 PRIOR ART
FIG. 4 is a fragmentary perspective view of another prior art nonradiative dielectric waveguide with a termination.
Figure 5:
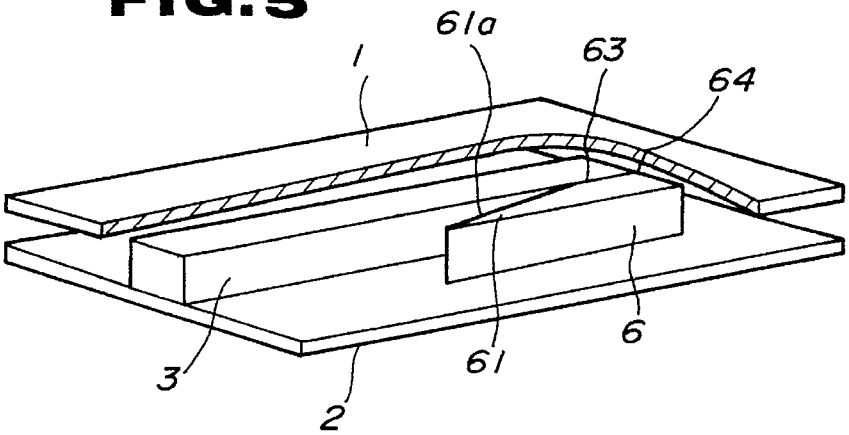
FIG. 5 is a fragmentary perspective view of a nonradiative dielectric waveguide according to one embodiment of the present invention.

As shown in FIG. 5, a nonradiative dielectric waveguide according to one embodiment of the present invention comprises a pair of parallel flat electrically conductive plates 1, 2 of a metallic material which are spaced from each other, a dielectric strip 3 sandwiched between the plates 1, 2, and a wave absorber 6 disposed between the plates 1, 2 parallel to the dielectric strip 3. The wave absorber 6 is positioned at one end of the dielectric strip 3 to serve as a termination in the nonradiative dielectric waveguide. The wave absorber 6 has a side surface held in contact with a side surface of the dielectric strip 3 which extends perpendicularly to the plates 1, 2. The wave absorber 6 has a tapered portion 61 defined by a slanted surface 61*a* that progressively approaches the confronting side surface of the dielectric strip 3. Along the direction in which input electromagnetic waves are propagated through the nonradiative dielectric waveguide, the slanted surface 61*a* is progressively closer to the dielectric strip 3.

The tapered portion 61 of the wave absorber 6 serves to attenuate reflections of input electromagnetic waves which are caused by impedance mismating. At an inlet end of the termination, the tip of the wave absorber 6 is spaced from the dielectric strip 3. From the inlet end of the termination where input electromagnetic waves are applied, the slanted surface 61*a* is progressively closer to the confronting side surface of the dielectric strip 3 until the wave absorber 6 is held in contact with the dielectric strip 3. The tapered portion 61 of such a structure is effective to substantially eliminate electromagnetic wave reflections.

The confronting sides of the dielectric strip 3 and the wave absorber 6 are held in contact with each other in a region 63 that extends from a terminal end 64 of the termination adjacent to the end of the dielectric strip 3 to the slanted surface 61*a*. Any increase in a voltage standing wave ratio (VSWR) due to reflections at the terminal end 64 can be reduced by selecting a suitable length of the region 63.

The wave absorber 6 may be made of a generally available material such as a mixture of epoxy resin and a resistive material.

With the structure of the nonradiative dielectric waveguide shown in FIG. 5, the wave absorber 6 is located in a position alongside of the dielectric strip 3 where the electromagnetic field is relatively weak, the wave absorber 6 is less exposed to the electromagnetic field, and reflections are relatively small. The wave absorber 6 is progressively closer to the dielectric strip 3 through the tapered portion 61 to achieve impedance matching until finally the wave absorber 6 is held in contact with the dielectric strip 3 in the region 63 for attenuating input electromagnetic waves. Therefore, the attenuation of the termination for attenuating the input electromagnetic waves do not vary with small changes in the shape of the wave absorber 6.

Thus, the nonradiative dielectric waveguide shown in FIG. 5 has good attenuation for optimum termination functions, and can have uniform attenuation when mass-produced.

Wave absorbers 6 with tapered portions 61 may be positioned one on each side of, and held against, the dielectric strip 3 in a symmetric pattern. Such an arrangement is effective to increase the rate of attenuation of electromagnetic waves per unit length, making it possible to reduce the length of the termination along the nonradiative dielectric waveguide.

Figure 6:
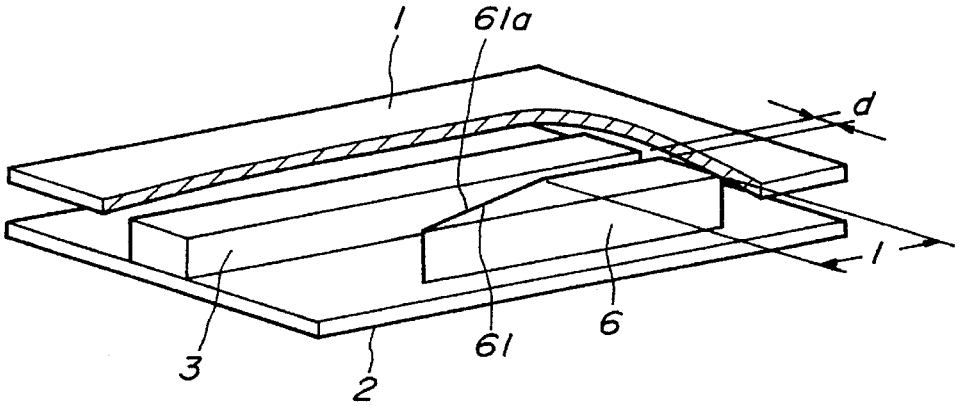
FIG. 6 is a fragmentary perspective view of a nonradiative dielectric waveguide according to another embodiment of the present invention.

FIG. 6 shows a nonradiative dielectric waveguide according to another embodiment of the present invention. The nonradiative dielectric waveguide shown in FIG. 6 is designed to provide an attenuator for limiting the output power of an oscillator in a millimetric wave radar system. As shown in FIG. 6, the nonradiative dielectric waveguide comprises a pair of parallel flat electrically conductive plates 1, 2 of a metallic material which are spaced from each other, a dielectric strip 3 sandwiched between the plates 1, 2, and a wave absorber 6 disposed between the plates 1, 2 parallel to the dielectric strip 3. The wave absorber 6 serves as an attenuator in the nonradiative dielectric waveguide. The wave absorber 6 has a side surface spaced from a side surface of the dielectric strip 3 which extends perpendicularly to the plates 1, 2. The wave absorber 6 has a tapered portion 61 defined by a slanted surface 61*a* that progressively approaches the confronting side surface of the dielectric strip 3 for attenuating the power of input electromagnetic waves to a predetermined level. Along the direction in which input electromagnetic waves are propagated through the nonradiative dielectric waveguide, the slanted surface 61*a* progressively approaches the dielectric strip 3.

Electromagnetic waves that are propagated through the nonradiative dielectric waveguide are propagated primarily through the dielectric strip 3 and also spread outside of the dielectric strip 3. Therefore, the wave absorber 6 positioned outside of the dielectric strip 3 can sufficiently attenuate input electromagnetic waves.

The attenuation factor of electromagnetic waves may be varied by adjusting the distance d between the dielectric strip 3 and the wave absorber 6 and the length l of the region where the dielectric strip 3 and the wave absorber 6 are spaced from each other by the distance d.

In an unshown further embodiment, two wave absorbers 6 with tapered portions 61 may be positioned one on each side of, and spaced from, the dielectric strip 3 in a symmetric pattern. Such an arrangement is effective to increase the rate of attenuation of electromagnetic waves per unit length, making it possible to reduce the length of the attenuator along the nonradiative dielectric waveguide.

The tapered portion 61 is positioned at the inlet end of the wave absorber 6 where input electromagnetic waves are applied, to prevent standing waves from being generated which would otherwise be developed if only a rectangular wave absorber were placed alongside of the dielectric strip 3.

Figure 7:
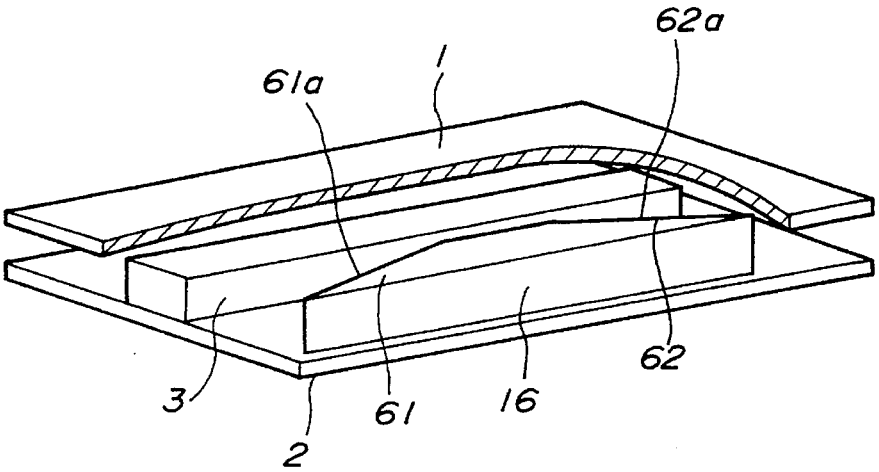
FIG. 7 is a fragmentary perspective view of a nonradiative dielectric waveguide according to still another embodiment of the present invention.

FIG. 7 shows a nonradiative dielectric waveguide according to still another embodiment of the present invention. The nonradiative dielectric waveguide shown in FIG. 7 is arranged to prevent standing waves from being generated at inlet and outlet ends thereof. The nonradiative dielectric waveguide comprises a pair of parallel flat electrically conductive plates 1, 2 of a metallic material which are spaced from each other, a dielectric strip 3 sandwiched between the plates 1, 2, and a wave absorber 16 disposed between the plates 1, 2 parallel to the dielectric strip 3. The wave absorber 16 serves as an attenuator in the nonradiative dielectric waveguide. The wave absorber 16 has a side surface spaced from a side surface of the dielectric strip 3 which extends perpendicularly to the plates 1, 2. The wave absorber 16 has a pair of tapered portions 61, 62 on its respective opposite ends which are defined by respective slanted surfaces 61*a*, 62*a* that are progressively closer to the confronting side surface of the dielectric strip 3 for attenuating the power of input electromagnetic waves to a predetermined level. Along the direction in which input electromagnetic waves are propagated through the nonradiative dielectric waveguide, the slanted surface 61*a* is progressively closer to the dielectric strip 3 and the slanted surface 62*a* progressively diverges from the dielectric strip 3.

The attenuator shown in FIG. 7 is effective for bidirectional use in the nonradiative dielectric waveguide.

The waveguide is not restricted to the nonradiative waveguide (NRD), but may be an image guide, an insular guide or an H guide.

Although there have been described what are at present considered to be the preferred embodiments of the invention, it will be understood that the invention may be embodied in other specific forms without departing from the essential characteristics thereof. The present embodiments are therefore to be considered in all respects as illustrative, and not restrictive. The scope of the invention is indicated by the appended claims rather than by the foregoing description.

What is claimed is:

1. A dielectric waveguide comprising:

first and second electrically conductive plates;

a dielectric strip mounted on said first electrically conductive plate and located between said first and second electrically conductive plates, said dielectric strip having a first surface substantially normal to and extending linearly along said first electrically conductive plate; and a wave absorber disposed on said first electrically conductive plate substantially adjacent and having a side surface parallel to said first surface of said dielectric strip, said wave absorber having a tapered surface normal to said first electrically conductive plate, said tapered surface extending from said side surface to an input end of said wave absorber, so as to define an acute angle for the tapered surface which approaches said first surface of said dielectric strip.

2. The dielectric waveguide of claim 1, wherein said side surface of said wave absorber is coupled to said first surface of said dielectric strip, whereby said wave absorber provides a termination for eliminating reflections of input electromagnetic waves applied to the dielectric waveguide.

3. The dielectric waveguide of claim 1, wherein said side surface of said wave absorber is parallel to and spaced apart from said first surface of said dielectric strip, whereby said wave absorber provides an attenuator for attenuating a power of input electromagnetic waves applied to the dielectric waveguide.

4. The dielectric waveguide of claim 1, wherein said wave absorber has a second tapered surface normal to said first and second electrically conductive plates, said second tapered surface extending from said side surface to an output end of said wave absorber, so as to define an acute angle for the second tapered surface which approaches said first surface of said dielectric strip.

5. A dielectric waveguide comprising:

a pair of parallel flat metallic plates spaced from each other;

a dielectric strip sandwiched between said parallel flat metallic plates, said dielectric strip having a first surface substantially normal to and extending linearly along said plates; and a wave absorber sandwiched between said parallel flat metallic plates and being substantially adjacent to and having a side surface parallel to said first surface of said dielectric strip, said wave absorber having a tapered surface normal to said plates, said tapered surface extending from said side surface to an input end of said wave absorber, so as to define an acute angle for the tapered surface which approaches said first surface of said dielectric strip.

6. The dielectric waveguide of claim 5, wherein said side surface of said wave absorber is coupled to said first surface of said dielectric strip, whereby said wave absorber provides a termination for eliminating reflections of input electromagnetic waves applied to the dielectric waveguide.

7. The dielectric waveguide of claim 5, wherein said side surface of said wave absorber is parallel to and spaced apart from said first surface of said dielectric strip, whereby said wave absorber provides an attenuator for attenuating a power of input electromagnetic waves applied to the dielectric waveguide.

8. The dielectric waveguide of claim 5, wherein said wave absorber has a second tapered surface normal to said electrically conductive plates, said second tapered surface extending from said side surface to an output end of said wave absorber, so as to define an acute angle for the second tapered surface which approaches said first surface of said dielectric strip.

* * * * *